US007238110B2

(12) United States Patent
Glavich et al.

(10) Patent No.: US 7,238,110 B2
(45) **Date of Patent: *Jul. 3, 2007**

(54) GAMING DEVICE HAVING A RE-TRIGGERING SYMBOL BONUS SCHEME WITH A BONUS SYMBOL ACCUMULATOR

(75) Inventors: Paulina Glavich, Reno, NV (US); Karen M. Cregan, Reno, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/196,930

(22) Filed: Aug. 4, 2005

(65) Prior Publication Data

US 2005/0266917 A1 Dec. 1, 2005

Related U.S. Application Data

(63) Continuation of application No. 10/071,441, filed on Feb. 8, 2002, now Pat. No. 6,955,600, which is a continuation-in-part of application No. 09/981,133, filed on Oct. 15, 2001, now Pat. No. 6,913,532.

(51) Int. Cl.
*A63F 9/24* (2006.01)

(52) U.S. Cl. ..... 463/20; 463/16; 273/143 R

(58) Field of Classification Search ..... 463/16, 463/20, 25, 42; 273/143 R
See application file for complete search history.

(56) References Cited

U.S. PATENT DOCUMENTS 4,198,052 A 4/1980 Gauselmann
4,624,459 A 11/1986 Kaufman
4,695,053 A 9/1987 Vazquez, Jr. et al.
5,205,555 A 4/1993 Hamano
5,449,173 A 9/1995 Thomas et al.
5,456,465 A 10/1995 Durham (Continued)

FOREIGN PATENT DOCUMENTS

WO WO 01/26019 A1 4/2001

OTHER PUBLICATIONS

Ghoulish Gamble Advertisement written by Strictly Slots, published in Nov. 2000.

(Continued)

*Primary Examiner*—Kim Nguyen
(74) *Attorney, Agent, or Firm*—Bell, Boyd & Lloyd LLP

(57) ABSTRACT

A gaming device having a bonus scheme wherein an accumulator accumulates bonus re-triggering symbols until a pre-determined number of bonus re-triggering symbols are obtained by the player in the bonus game. The accumulated bonus re-triggering symbols are preferably the same symbol. In one embodiment, the bonus re-triggering symbols in the bonus game are the same symbol as the bonus triggering symbols in the primary game. In another embodiment, the bonus re-triggering symbols in the bonus game are different symbols than the bonus trigger symbols in the primary game. The bonus scheme of the present invention is preferably employed in conjunction with one or more other re-trigger bonus schemes. In another embodiment, the accumulator is employed as a bonus re-triggering event in the bonus game.

39 Claims, 9 Drawing Sheets

U.S. PATENT DOCUMENTS

| | | | | |
|---|---|---|---|---|
| 5,722,891 | A | | 3/1998 | Inoue |
| 5,788,573 | A | | 8/1998 | Baerlocher et al. |
| 5,823,874 | A | | 10/1998 | Adams |
| 5,947,820 | A | | 9/1999 | Morro et al. |
| 5,980,384 | A | | 11/1999 | Barrie |
| 6,004,207 | A | | 12/1999 | Wilson, Jr. et al. |
| 6,012,982 | A | | 1/2000 | Piechowiak et al. |
| 6,015,346 | A | | 1/2000 | Bennett |
| 6,056,642 | A | | 5/2000 | Bennett |
| 6,059,289 | A | | 5/2000 | Vancura |
| 6,089,976 | A | | 7/2000 | Schneider et al. |
| 6,126,542 | A | | 10/2000 | Fier |
| 6,135,884 | A | * | 10/2000 | Hedrick et al. ..... 463/20 |
| 6,155,925 | A | | 12/2000 | Giobbi et al. |
| 6,159,095 | A | | 12/2000 | Frohm et al. |
| 6,159,097 | A | | 12/2000 | Gura |
| 6,159,098 | A | | 12/2000 | Slomiany et al. |
| 6,168,523 | B1 | | 1/2001 | Piechowiak et al. |
| 6,190,255 | B1 | | 2/2001 | Thomas et al. |
| 6,203,429 | B1 | | 3/2001 | Demar et al. |
| 6,224,483 | B1 | | 5/2001 | Mayeroff |
| 6,231,442 | B1 | | 5/2001 | Mayeroff |
| 6,231,445 | B1 | | 5/2001 | Acres |
| 6,234,897 | B1 | | 5/2001 | Frohm et al. |
| 6,238,287 | B1 | | 5/2001 | Komori et al. |
| 6,311,976 | B1 | | 11/2001 | Yoseloff et al. |
| 6,312,334 | B1 | | 11/2001 | Yoseloff |
| 6,328,649 | B1 | | 12/2001 | Randall et al. |
| 6,346,043 | B1 | | 2/2002 | Colin et al. |
| 6,347,996 | B1 | | 2/2002 | Gilmore et al. |
| 6,358,147 | B1 | | 3/2002 | Jaffe et al. |
| 6,364,766 | B1 | | 4/2002 | Anderson et al. |
| 6,364,768 | B1 | | 4/2002 | Acres et al. |
| 6,368,216 | B1 | | 4/2002 | Hedrick et al. |
| 6,375,567 | B1 | | 4/2002 | Acres |
| 6,398,218 | B1 | | 6/2002 | Vancura |
| 6,443,452 | B1 | | 9/2002 | Brune |
| 6,491,584 | B2 | | 12/2002 | Graham et al. |
| 6,533,658 | B1 | | 3/2003 | Walker et al. |
| 6,561,904 | B2 | * | 5/2003 | Locke et al. ..... 463/25 |
| 6,955,600 | B2 | * | 10/2005 | Glavich et al. ..... 463/20 |
| 2003/0060272 | A1 | | 3/2003 | Glavich et al. |
| 2005/0233801 | A1 | | 10/2005 | Baerlocher et al. |

OTHER PUBLICATIONS

Top Dollar Advertisement written by IGT, published in 1998.
Winning Bid Advertisement written by WMS Gaming Inc., published prior to Jan. 2001.
Triple Bucks Advertisement written by IGT, published in 1999.
Addams Family Article written by IGT, published in 2000.
Dolphin Treasure Advertisement written by Aristocrat Leisure Industries Pty. Ltd, published in 1996.
"Money in the Bank," Published by Strictly Slots, available Jun. 2001.

* cited by examiner

GAMING DEVICE HAVING A RE-TRIGGERING SYMBOL BONUS SCHEME WITH A BONUS SYMBOL ACCUMULATOR

PRIORITY CLAIM

This application is a continuation of, claims the benefit of, and priority to U.S. patent application Ser. No. 10/071,441, filed Feb. 8, 2002, now issued as U.S. Pat. No. 6,955,600, which is a continuation-in-part of, claims priority to and the benefit of U.S. patent application Ser. No. 09/981,133, filed Oct. 15, 2001, now issued as U.S. Pat. No. 6,913,532, the entire contents of which is incorporated herein.

CROSS REFERENCE TO RELATED APPLICATIONS

This application relates to the following co-pending commonly owned applications: "GAMING DEVICE HAVING A RE-TRIGGERING SYMBOL BONUS SCHEME," Ser. No. 09/981,133.

This application relates to the following co-pending commonly owned patent applications: "GAMING DEVICE HAVING FREE GAMES BONUS WITH A CHANGING MULTIPLIER," Ser. No. 10/086,146; "GAMING DEVICE HAVING A BONUS GAME WITH MULTIPLE PLAYER SELECTABLE AWARD OPPORTUNITIES," Ser. No. 10/237,207; "GAMING DEVICE HAVING BONUS GAME WITH MULTIPLE PLAYER SELECTABLE AWARD OPPORTUNITIES," Ser. No. 10/660,076; "GAMING DEVICE HAVING SEQUENTIAL ACTIVATIONS OF A GAME AND REPLAY OF PREVIOUS ACTIVATIONS OF THE GAME," Ser. No. 10/956,508; "GAMING DEVICE WITH CHANGING WILD SYMBOLS," Ser. No. 10/956,303; "GAMING DEVICE HAVING FREE SPIN MODE WITH SYMBOL ELIMINATION," Ser. No. 10/953,818; "GAMING DEVICE HAVING A RE-TRIGGERING SYMBOL BONUS SCHEME WITH A BONUS SYMBOL ACCUMULATION AND PLAYER SELECTION OF ACCUMULATION TOTAL," Ser. No. 10/952,656; and "GAMING DEVICE HAVING A RE-TRIGGERING SYMBOL BONUS SCHEME," Ser. No. 11/156,112.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

The present invention relates in general to a gaming device, and more particularly to a gaming device having a re-triggering symbol bonus scheme with a bonus symbol accumulator.

The base or primary game of most slot machines involves one or more mechanical or video spinning reels, each of which display a plurality of symbols. In many such games, a triggering event such as a symbol or combination of symbols yield one or more opportunities or chances in a bonus or secondary game, which is played in addition to the base game.

It is desirable to provide players with new and different gaming devices with new and different bonus schemes for the enjoyment and entertainment of players.

SUMMARY

One embodiment of the present invention provides a gaming device having a slot base game and a slot bonus game wherein one or more bonus triggering symbols in the base game are employed as bonus re-triggers in the bonus game. In one preferred embodiment, the occurrence of a predetermined combination of a plurality of bonus triggering symbols (such as three bonus triggering symbols along a payline) in a base game triggers a corresponding bonus game. In that bonus game, the same bonus triggering symbols in any position (i.e., a scatter pay) functions as the bonus re-trigger in the bonus game which causes one or more additional activations of the reels or one or more re-triggers of that entire bonus game. The probability of obtaining the bonus re-trigger in the bonus game which is based on the same bonus symbols needed to trigger the bonus game in the base game is greater than the probability of obtaining the bonus trigger in the base game because the combination of bonus triggering symbols can occur anywhere on the reels in the bonus game to cause the bonus re-trigger (i.e., a scatter pay).

Accordingly, the present invention provides a gaming device, which includes a symbol or symbol combination in a primary or base game which triggers a secondary or bonus game, and a symbol or symbol combination in the secondary or bonus game which is more likely to occur in the bonus game and which re-triggers the secondary or bonus game or a portion thereof. More generally, the present invention provides a gaming device which includes a bonus triggering event in a primary or base game which triggers a secondary or bonus game and a bonus re-triggering event in the secondary or bonus game which re-triggers the secondary or bonus game or a portion thereof. The bonus triggering event in the primary or base game and the bonus re-triggering event in the secondary or bonus game preferably employ the same symbols or symbol combinations such that the bonus re-triggering event in the secondary or bonus game is more likely to occur in the bonus game than the bonus triggering event in the primary or base game.

The bonus re-trigger in the bonus game may, for instance, provide the player a bonus game extension such as additional or free spins in the bonus game, a replay of the entire bonus game, or a modification to the bonus game such as changing the bonus re-triggering symbol or bonus re-triggering combination of symbols in the bonus game. The bonus-retrigger can alternatively cause other changes in the bonus game as desired by the game implementor. For instance, the bonus re-trigger may cause a modification of the bonus award pay scale or table such as doubling or tripling subsequent award values in the bonus game.

In an alternative embodiment of the present invention, an accumulator accumulates bonus triggering symbols until a pre-determined number of secondary game or bonus re-triggering symbols are obtained by a player in the secondary game or bonus game. The accumulated bonus re-triggering symbols are in one embodiment, preferably the same symbol. Additionally, the bonus re-triggering symbols in the bonus game may be the same symbol as the bonus triggering symbol in the primary game or a different symbol. The accumulator preferably accumulates bonus re-triggering symbols in conjunction with one or more bonus re-triggering events. Once the accumulator accumulates the predetermined number of bonus re-triggering symbols in the bonus game, the gaming device provides the player with a bonus re-trigger. The re-triggering of the bonus game includes at least one re-trigger of the bonus game, at least one additional spin in the bonus game, at least one additional turn, or any combination thereof.

In a further embodiment, the gaming device provides a bonus re-trigger to the player when the accumulator accumulates the bonus triggering symbols in a pre-determined order in the bonus game. In this embodiment, the bonus re-triggering symbols are preferably accumulated one at a time. Alternatively, the symbols may be accumulated in one or more turns.

In yet another embodiment, the gaming device provides a bonus re-trigger to the player when the accumulator accumulates a predetermined number of activated bonus triggering symbols.

It is therefore an advantage of the present invention to provide a gaming device having are-triggering symbol bonus scheme.

It is another advantage of the present invention to provide a gaming device having a re-triggering symbol bonus scheme in conjunction with other re-triggering symbol bonus schemes.

Other features and advantages of the invention will be apparent from the following detailed disclosure, taken in conjunction with the accompanying sheets of drawings, wherein like numerals refer to like parts, elements, components, steps and processes.

DETAILED DESCRIPTION

Gaming Device and Electronics

Figure 1A:
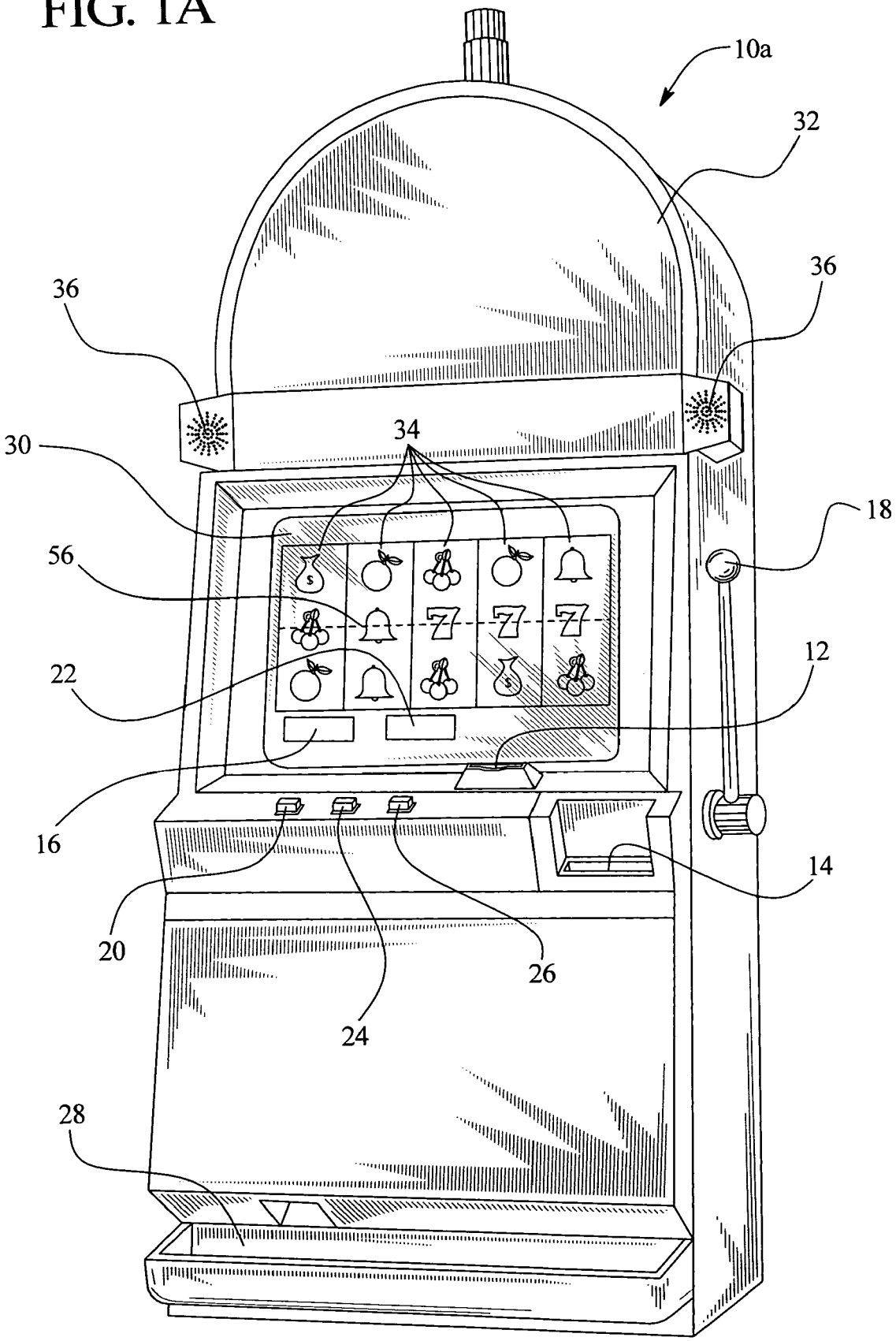
FIG. 1A is a front elevation view of a general embodiment of the gaming device of the present invention.
Figure 1B:
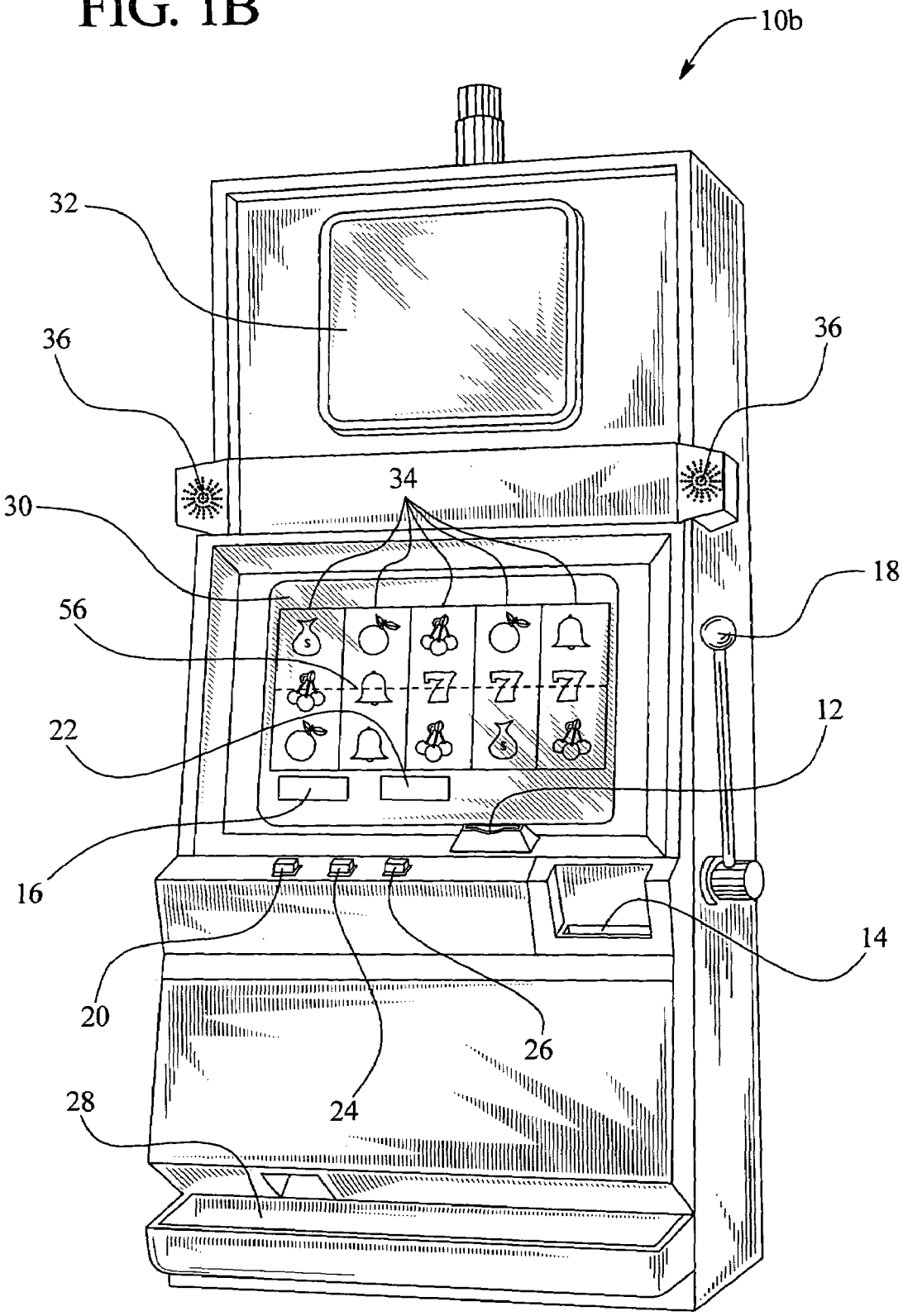
FIG. 1B is a front elevation view of a second embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is in one embodiment a slot machine having the controls, displays and features of a conventional slot machine. It is constructed so that a player can operate it while standing or sitting, and is preferably mounted in a console or cabinet. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 may be adapted to incorporate any primary game such as slot, poker, blackjack, keno, or any of the bonus triggering events and any of the bonus round games associated with these games, in conjunction with the present invention. The symbols and indicia used on and in gaming device 10 may be in mechanical, electronic, electrical or video form.

As illustrated in FIGS. 1A and 113, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 113, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. The gaming device may also include a conventional bet maximum button (not shown) and conventional payline bet buttons.

A player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 in one embodiment displays a plurality of reels 34 such as three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia or symbols such as bells, hearts, fruits, numbers, letters, bars or other images or symbols which preferably correspond to a theme associated with the gaming device 10. Furthermore, gaming device 10 preferably includes speakers 36 for making sounds or playing music.

Figure 2:
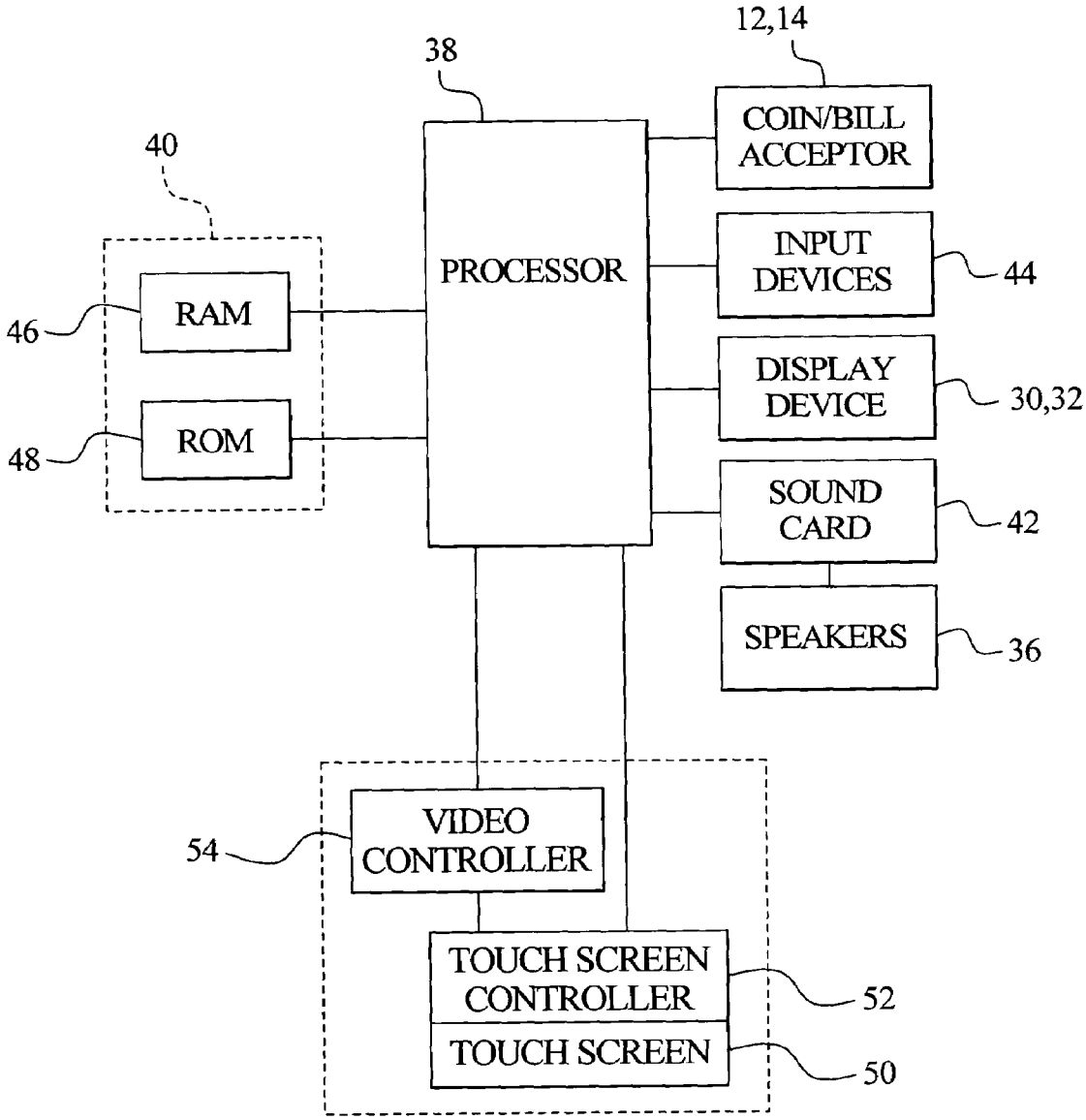
FIG. 2 is a schematic block diagram of the electronic configuration of one embodiment of the gaming device of the present invention.

As illustrated in FIG. 2, the general electronic combination of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The processor may include a main processor and a subprocessor which control certain features of the gaming device in conjunction with the main processor. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 are generally referred to herein as the "computer" or "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device as discussed in detail below. The gaming device 10 in one embodiment uses a video-based central display device 30 to enable the player to play the bonus round. In one embodiment as discussed below, the qualifying condition is a predetermined combination of indicia or symbols appearing on a plurality of reels 34. As illustrated in the five reel slot game shown in FIGS. 1A and 113, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Bonus Re-Trigger

Figure 3A:
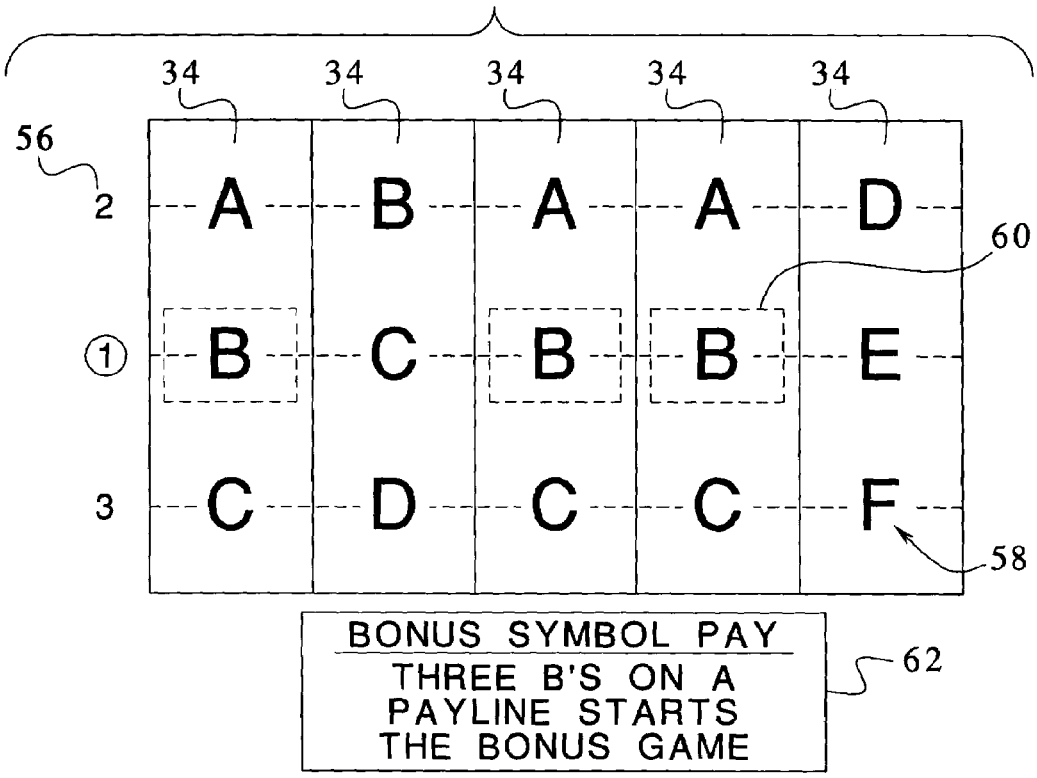
FIG. 3A is an enlarged front elevation view of one of the display devices of FIGS. 1A and 1B showing an embodiment of a bonus triggering symbol combination.

Referring now to FIG. 3A, a set of mechanical or video reels 34 is generally illustrated having symbols 58 designated as A through F. It should be appreciated that any suitable set of symbols could be used as the symbols 58 in accordance with the present invention. In this embodiment, the "B" symbols 60 are the bonus symbols and the appearance of three "B" symbols on any activated payline such as payline 1, triggers a bonus game as indicated by bonus display 62. Although in this example three "B" symbols are used to trigger the bonus game, it should be appreciated that any symbol combination having the same symbol or designated symbols may be used as the bonus triggering combination.

Figure 3B:
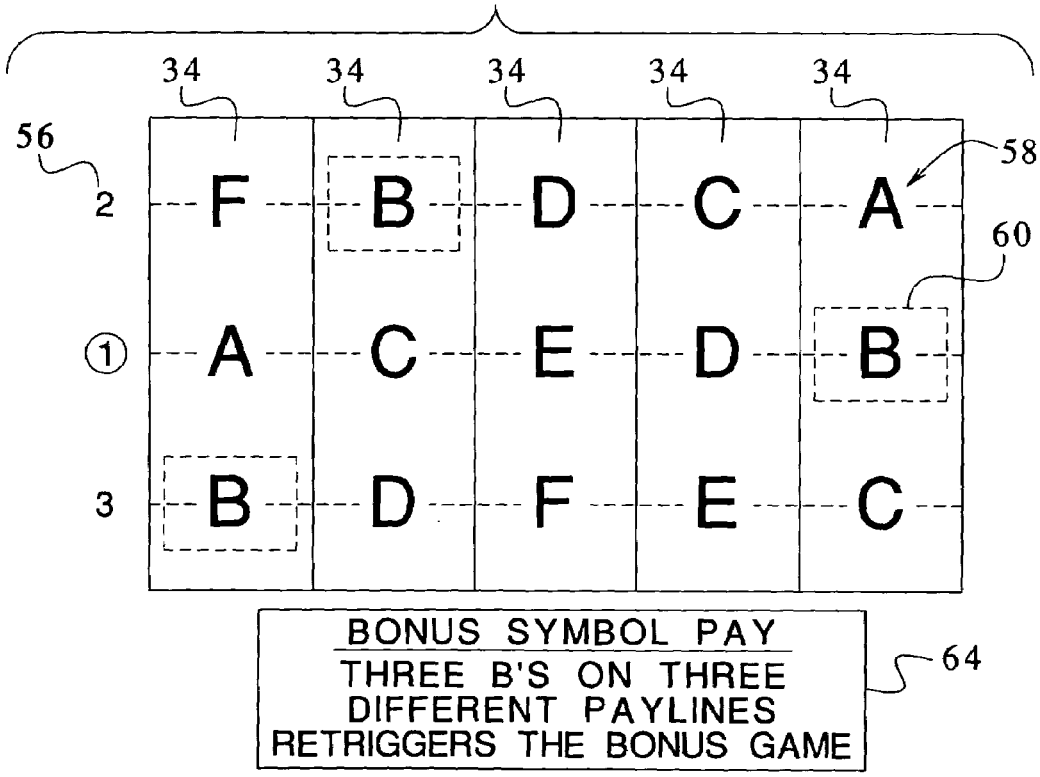
FIG. 3B is an enlarged front elevation view of one of the display devices of FIGS. 1A and 1B illustrating a bonus re-trigger symbol combination in a bonus game.

FIG. 3B illustrates one embodiment of the bonus game of the present invention where the bonus re-trigger occurs in the bonus game when the same symbols, which trigger the bonus game in the base game, are displayed in a scattered combination on multiple paylines. In this embodiment, the "B" symbol 60 is the bonus re-trigger symbol and any three "B" symbols on three paylines provides the bonus re-trigger in the bonus game as described in bonus display 64. Accordingly, as described above, in accordance with the present invention, the bonus re-trigger will occur more frequently than the bonus trigger because the bonus trigger will only occur when the bonus triggering symbols are aligned along a payline. The bonus re-trigger, however, will occur when the bonus triggering symbols are aligned along a payline or when the bonus triggering symbols occur along any payline.

Figure 4:
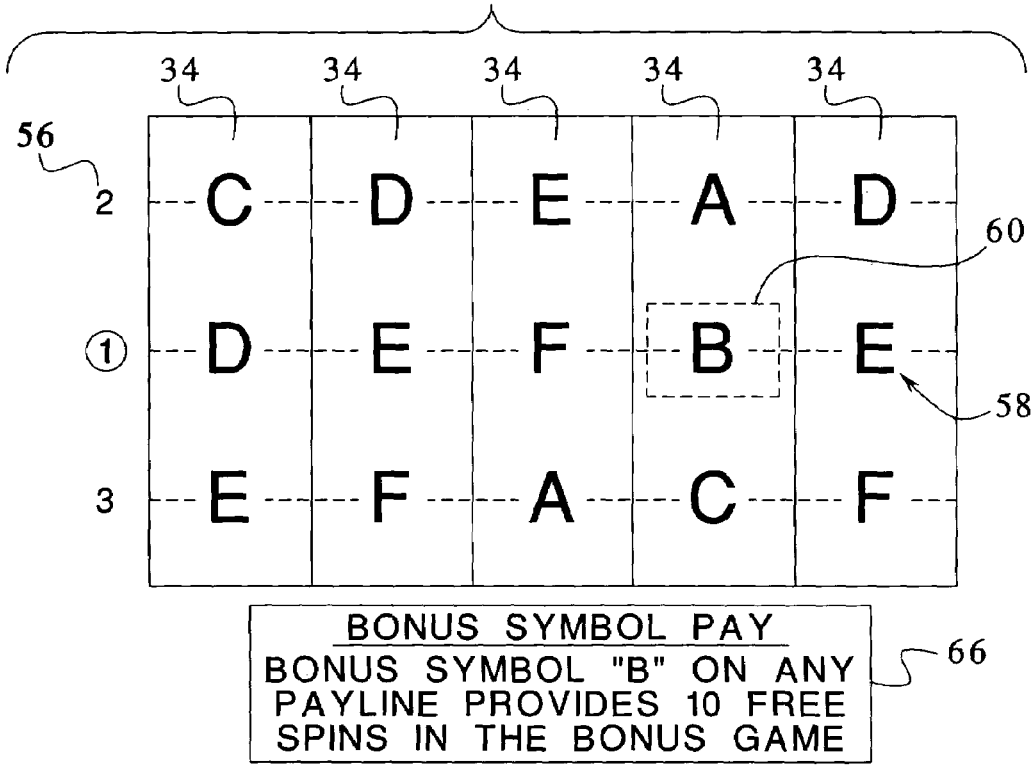
FIG. 4 is an enlarged front elevation view of one of the display devices of FIGS. 1A and 1B illustrating a bonus re-trigger in a bonus game where a player receives additional spins.

Referring now to FIG. 4, one embodiment of the present invention is shown where the bonus re-trigger occurs when one bonus triggering symbol occurs. In this example, the bonus game was triggered by obtaining a predetermined combination of the bonus symbols "B" 60 as illustrated in FIG. 3A, for instance. The bonus triggering symbol "B" is the bonus re-trigger symbol in the bonus game. In otherwords, any one of the bonus symbols "B" which in combination trigger the bonus game in the base game, is the symbol in the bonus game which provides a bonus re-trigger in the bonus game. In one embodiment, only one bonus symbol 60 located on any payline 56 is required to obtain a bonus re-trigger in the bonus game. It should be appreciated, however, that any combination of the same bonus symbols, which is more likely to occur in the bonus game than in the primary game, may be used to obtain a bonus re-trigger in the bonus game in accordance with the present invention. Thus, the present invention provides a bonus game which increases the chances of obtaining a bonus re-trigger using the same primary symbols by requiring less of those symbols in the bonus game to obtain a bonus re-trigger than in the primary game, or by requiring a more likely to occur combination of those symbols in the bonus game to obtain a re-trigger in the bonus game. Returning now to FIG. 4, the appearance of bonus symbol "B" 60 in the bonus game, causes a bonus re-trigger for the player in the bonus game. The bonus re-trigger is 10 free spins in the bonus game as designated by the bonus display 66.

Figure 5A:
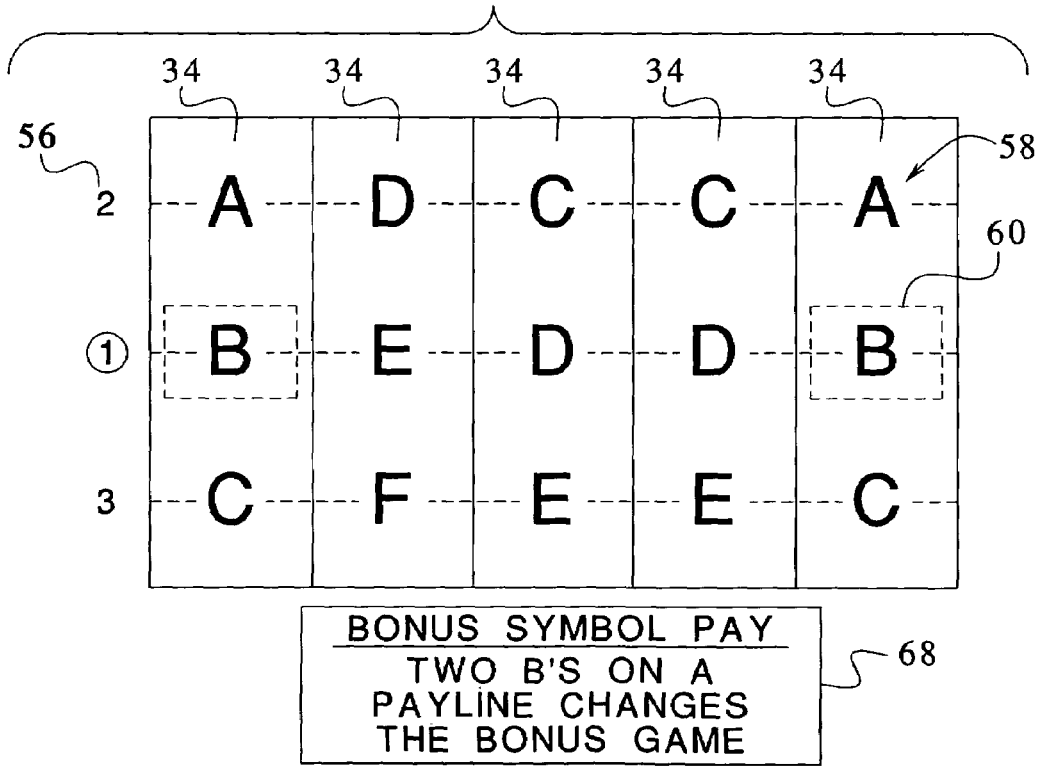
FIG. 5A is an enlarged front elevation view of one of the display devices of FIGS. 1A and 1B showing a bonus re-trigger where the bonus re-triggering combination is two "B" symbols on a payline.
Figure 5B:
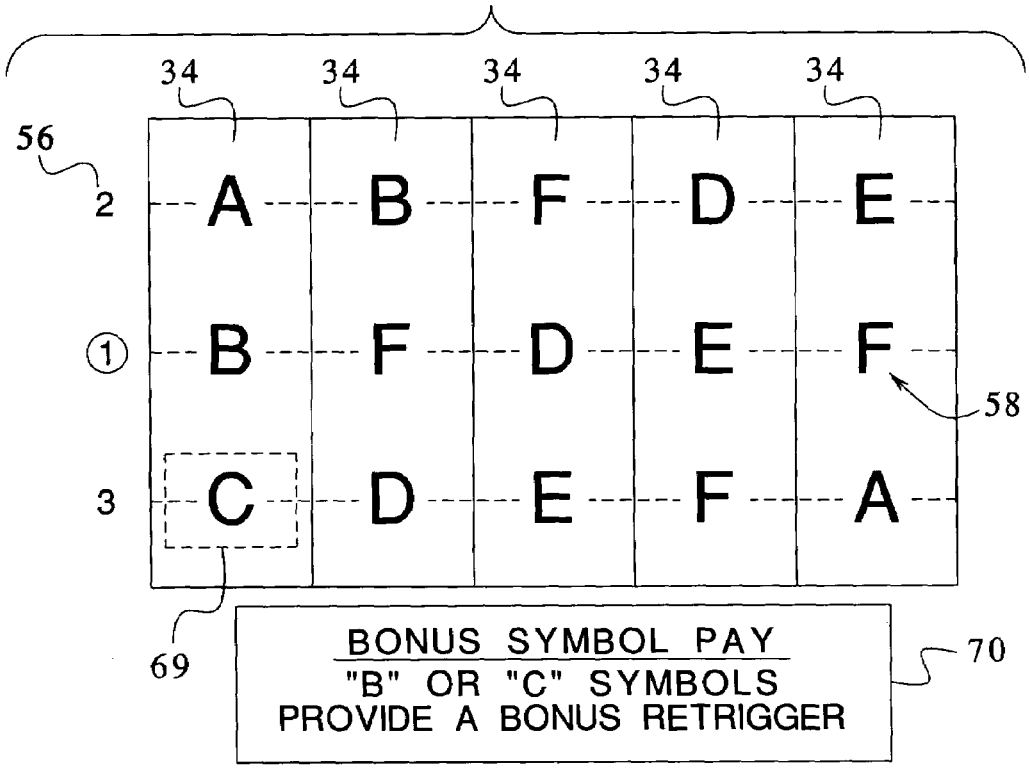
FIG. 5B is an enlarged front elevation view of one of the display devices of FIGS. 1A and 1B illustrating a bonus re-trigger where the bonus re-triggering symbol is a different symbol.

Another embodiment of the present invention is illustrated in FIGS. 5A and 5B. In this embodiment, the bonus re-trigger restructures or changes how the bonus game is subsequently re-triggered, initiated, played or the structure or type of the bonus game. Initially, the bonus game was triggered by obtaining three "B" symbols along a payline as shown in FIG. 3A, for instance.

The bonus symbol "B" triggers the bonus re-trigger in the bonus game, which in this case, changes the bonus game re-triggering symbol combination or event.

In FIGS. 5A and 5B, a player obtains two "B" symbols which changes the bonus re-triggering symbol or bonus mode. In one embodiment, the probability of obtaining the bonus re-triggering symbol becomes even greater.

FIG. 5A illustrates one embodiment where the player obtains two "B" symbols 60 on one payline 56 in the bonus game which changes the bonus game as indicated by bonus display 68. This changes the bonus game to include another bonus re-triggering symbol "C."

In FIG. 5B, the bonus re-triggering symbol also now includes the "C" symbol 69 on any payline as described in bonus display 70. Since the bonus retrigger symbols now also includes the "C" symbol 69, the player has a better chance of obtaining the bonus re-trigger because both the "B" symbol and the "C" symbol now provide the bonus re-trigger in this new, modified, or changed bonus game. The bonus re-trigger could be for instance, additional spins of the reels wherein a player can obtain bonus awards. The new bonus game could also change the paylines or other functions of the game, increase or decrease the number of reels in the base game, or change to an entirely new bonus game.

Figure 6:
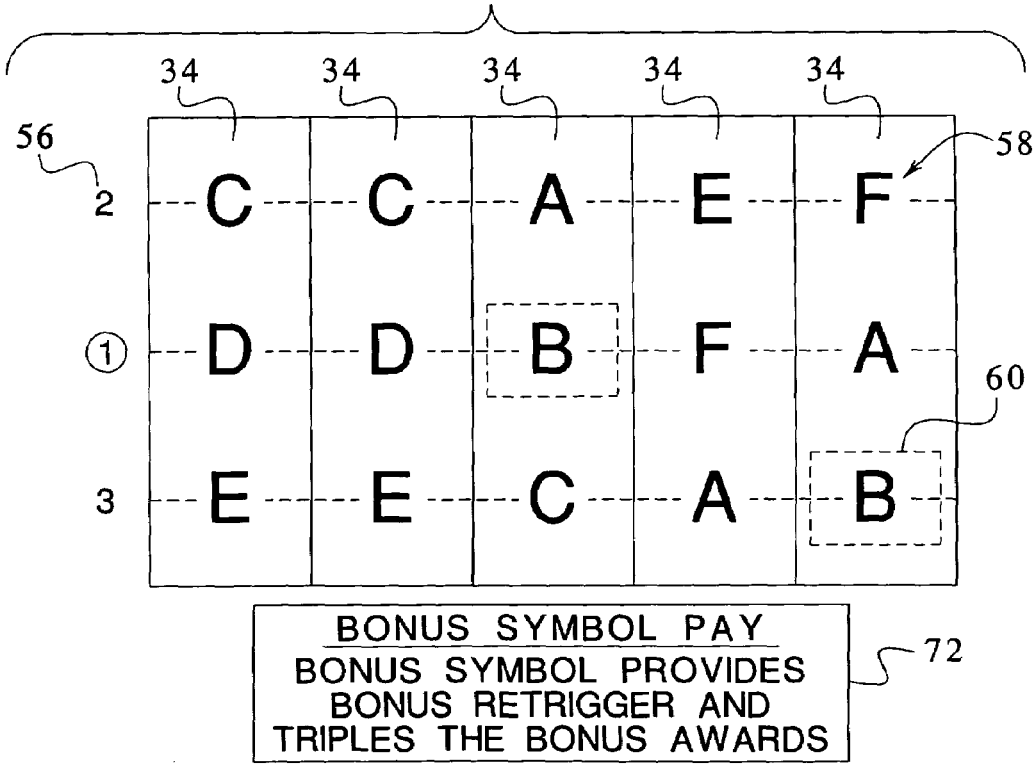
FIG. 6 is an enlarged front elevation view of one of the display devices of FIGS. 1A and 1B wherein the bonus re-trigger includes an award modification.

Referring now to FIG. 6, another embodiment of the present invention is shown where the bonus re-trigger additionally changes or modifies an award in the bonus game. In FIG. 6, the player entered the bonus game by obtaining a bonus triggering event that included three bonus symbols "B," designated by the numeral 60. The bonus symbol "B" is the bonus re-triggering symbol in the bonus game. The player obtains the bonus re-triggering symbol "B" on paylines one and three. Thus, the player receives the bonus re-trigger and a modification of the award provided to the player in the bonus game as described by bonus display 72, which includes tripling the bonus award values. It should be appreciated that any modifications of the bonus award values may be made including, but not limited to, multiplying the values by some factor or increasing the bonus award values by a fixed amount.

Figure 7A:
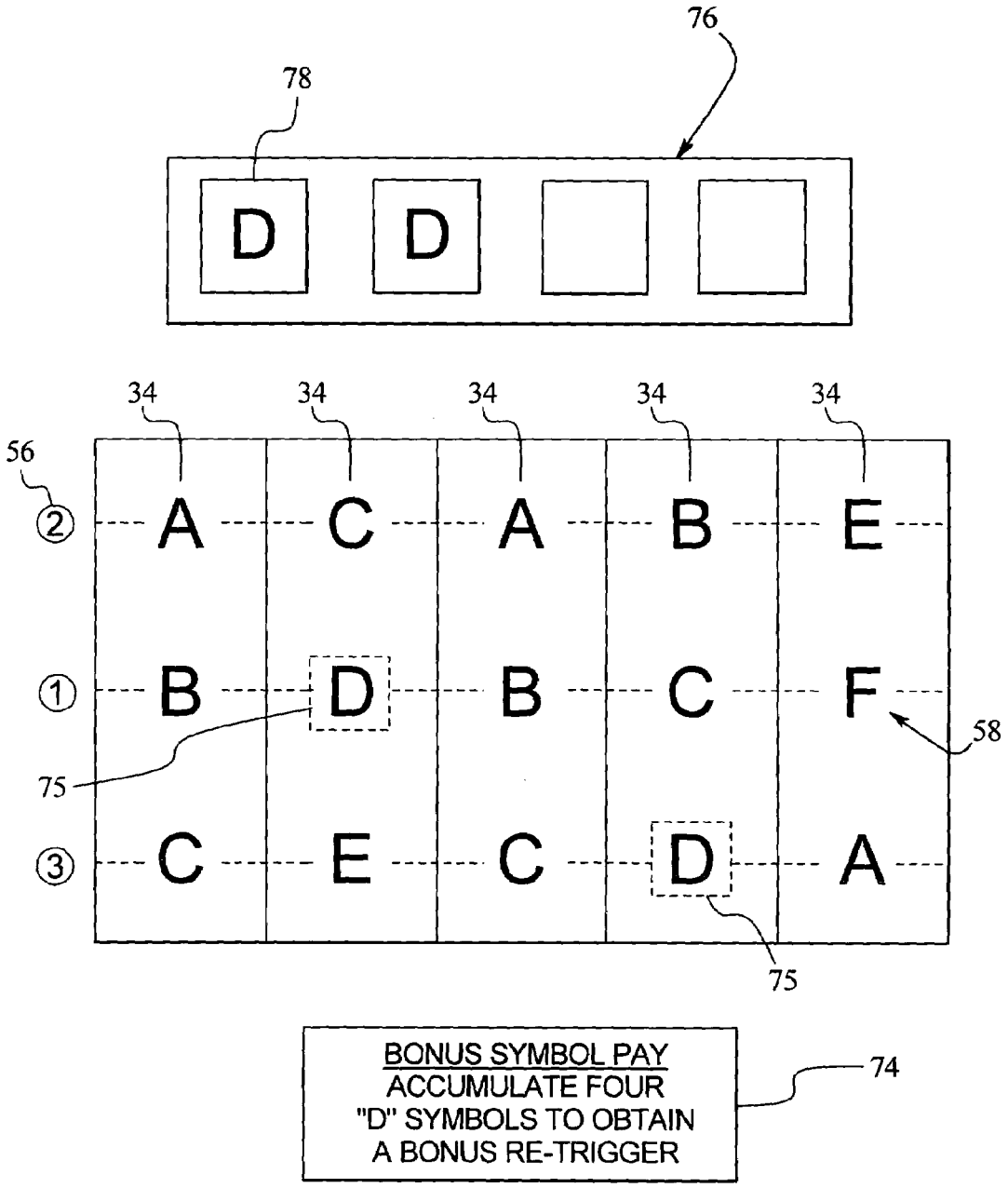
FIGS. 7A, 7B and 7C are enlarged front elevation views of one of the display devices of FIGS. 1A and 1B showing an alternative embodiment of the present invention where a player obtains a bonus re-trigger when the player accumulates four "D" symbols.
Figure 7B:
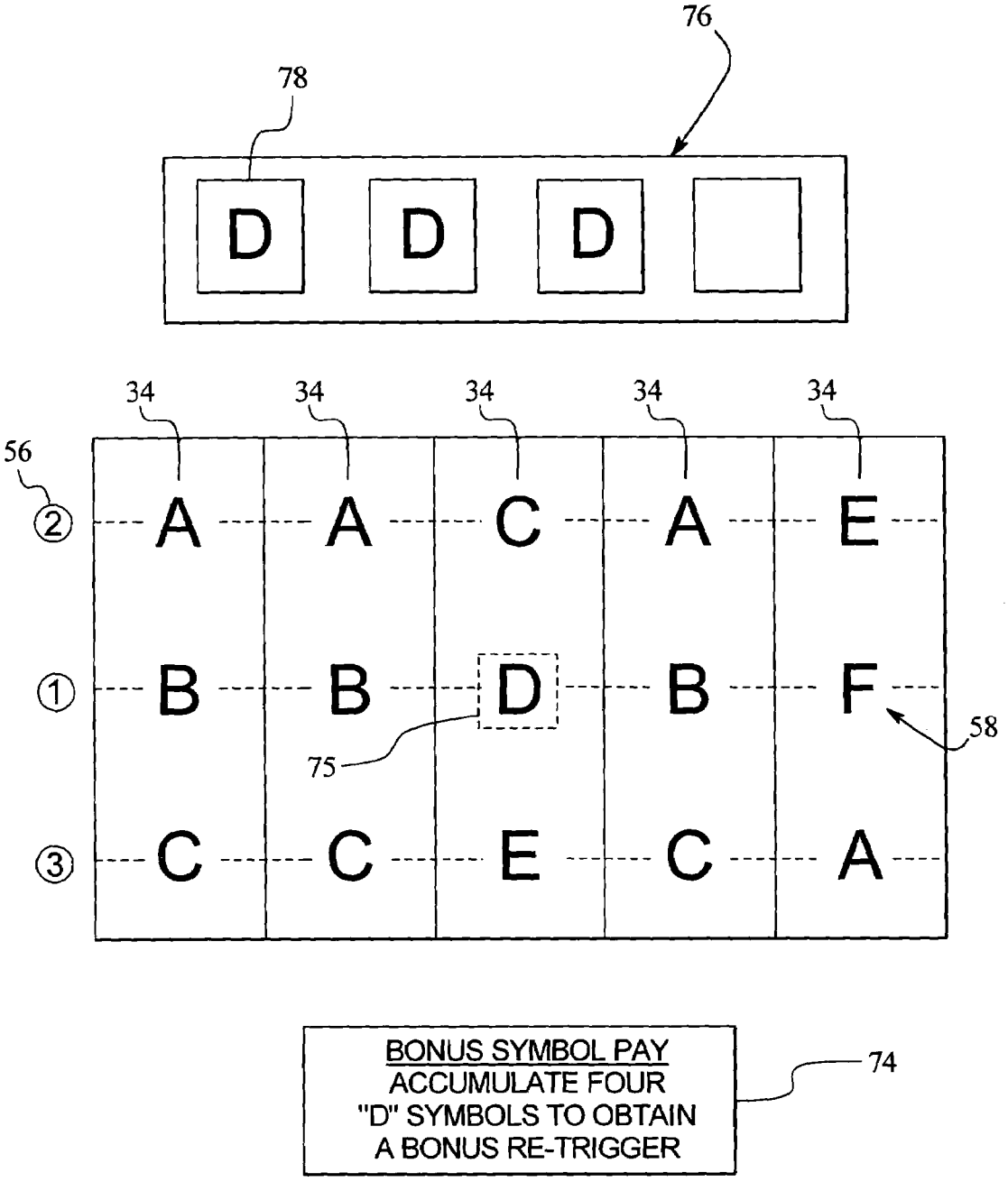
Figure 7C:
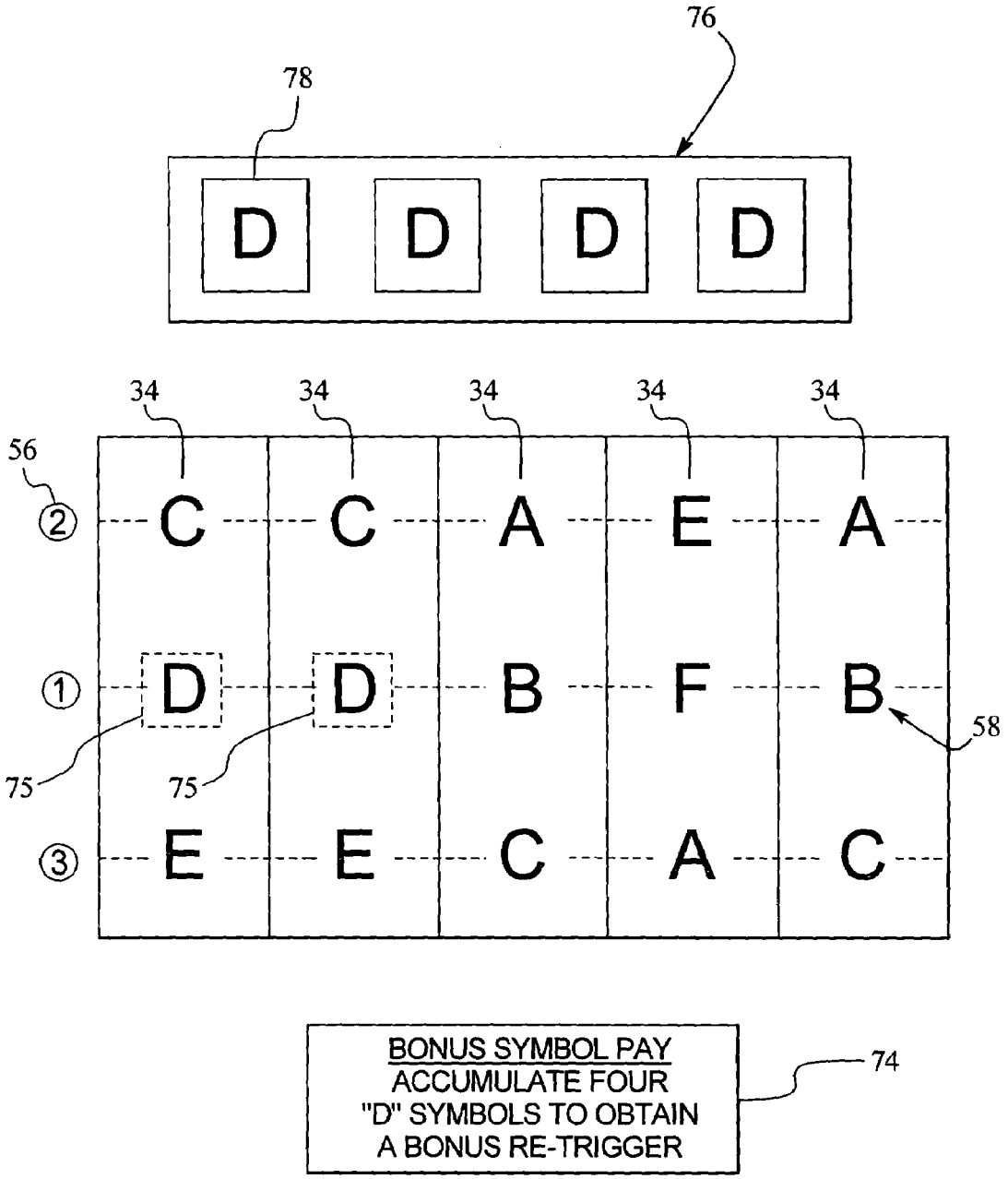

In another embodiment of the present invention illustrated in FIGS. 7A, 7B and 7C, an accumulator accumulates bonus re-triggering symbols until a pre-determined number of bonus re-triggering symbols are obtained by the player in the bonus game. In one embodiment, the player accumulates the same bonus re-triggering symbol to re-trigger the bonus game. It should be appreciated that the bonus re-triggering symbols needed to re-trigger the bonus game may include the same bonus re-triggering symbol, a plurality of the same bonus re-triggering symbols or different bonus re-triggering symbols.

The bonus re-triggering symbol in the bonus game may be the same symbol as the bonus triggering symbol in the primary game or a different symbol.

It should be appreciated that the number of bonus re-triggering symbols needed to re-trigger the bonus game may also be randomly determined by the processor. In this embodiment, a probability of being selected by the processor is associated with the number of bonus re-triggering symbols to be accumulated by the accumulator when the number is randomly determined by the processor.

In FIGS. 7A, 7B and 7C, the bonus re-triggering symbol in the bonus game is the same as the bonus triggering symbol in the primary game. The player entered the bonus game by obtaining a bonus triggering event that included three "D" symbols, designated by the numeral 75. In the bonus game, the player must accumulate four "ID" symbols in one or more of the free spins of the reels, provided to the player during the bonus game, which is now the bonus re-triggering symbol, to re-trigger the bonus game as indicated by bonus display 74. The bonus re-trigger may be an alternative to the bonus re-triggers described above or employed in a game in addition to the bonus retriggers described herein. Each time the player obtains a "D" symbol on one of the paylines 56 during play of the bonus game: the symbol is accumulated to one of the symbol displays 78 in the bonus re-trigger symbol accumulator display 76.

Referring specifically to FIG. 7A, during play of the bonus games, the player obtains the bonus re-triggering symbol "D", designated by the numeral 75, on paylines one and three. In this example, the player can obtain one "ID" symbol or a plurality of "D" symbols in each turn or spin. Each "D" symbol obtained by the player is accumulated in the bonus re-trigger symbol accumulator display 76. Therefore, the two "D" symbols obtained by the player in this turn are displayed in the bonus re-trigger symbol accumulator display 76. The player must accumulate or obtain two more "D" symbols to re-trigger the bonus game.

In the player's next turn or spin, the player obtains another "D" symbol as illustrated in FIG. 713. The "ID" symbol is accumulated in the bonus re-trigger symbol accumulator display 76. The player only needs to accumulate one more "ID" symbol to re-trigger the bonus game.

Referring to FIG. 7C, the player obtains a fourth "D" symbol in the bonus game. The final "D" symbol is accumulated in the bonus re-trigger symbol accumulator display 76 as displayed in each of the symbol displays 78. Thus, a bonus re-trigger is provided to the player.

It should be appreciated that the player could accumulate the predetermined number of bonus re-triggering symbols in a single turn or a plurality of turns. It should also be appreciated that this bonus re-trigger could be employed during one or a plurality of bonus games (including re-triggered bonus games). The bonus re-triggering event illustrated in FIGS. 7A, 7B and 7C may thus be employed with one or more other bonus re-triggering events in a bonus game. It should also be appreciated that this embodiment can also be employed as a sole bonus re-triggering event in a bonus game.

In another embodiment of the present invention, the player must accumulate the bonus re-triggering symbols in a particular order to obtain a bonus re-trigger in the bonus game. In this embodiment, if the player does not accumulate the bonus re-triggering symbols in the specified order, the player does not obtain a bonus re-trigger. Furthermore, the particular combination of bonus re-triggering symbols and the order of the bonus re-triggering symbols may be pre-determined or randomly determined by the processor.

In one embodiment, the player accumulates the bonus re-triggering symbols one at a time. For instance, if the first and second symbols in a predetermined order of the bonus re-triggering symbols appears on one or more paylines during the same turn, the player only accumulates the first bonus re-triggering symbol. The player accumulates the other bonus re-triggering symbols in the specified order in the player's remaining turns in the bonus game. It should be appreciated that a player can accumulate the bonus retriggering symbols in a pre-determined order during a single turn, or during a plurality of turns in the bonus game.

In a further embodiment, a bonus re-triggering symbol becomes activated in the bonus game. In this embodiment, the accumulator accumulates only the activated bonus re-triggering symbols until a predetermined number of activated bonus re-triggering symbols are obtained in the bonus game. The gaming device then provides the player with a bonus retrigger as described above.

In another embodiment, the primary and secondary games are operated in a data network such as the internet. In this manner, a player can access and play the primary and secondary games using a personal computer or similar device that has a data network or internet connection.

Accordingly, the present invention provides a gaming device which includes a secondary game triggering event in a primary game which triggers a secondary game, a secondary game re-triggering event in the secondary game which re-triggers the entire secondary game or a portion thereof, wherein the secondary game re-triggering event in the secondary game is more likely to occur in the secondary game than the secondary game triggering event in the primary game. In addition, the gaming device provides another opportunity to re-trigger the secondary game by including a secondary re-triggering symbol accumulator in the secondary game. The accumulator accumulates secondary re-triggering symbols until a pre-determined number of secondary re-triggering symbols are obtained in the secondary game. Preferably, the secondary game re-triggering event in the secondary game and the secondary game triggering event in the primary game employ the same triggering symbols.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device operable under control of a processor, said gaming device comprising:

a plurality of reels controlled by the processor;

a plurality of symbols on each of the reels;

a triggering event;

a plurality of winning symbol combinations of said symbols;

a plurality of awards associated with the winning symbol combinations; and at least one input device in communication with the processor, wherein the processor is programmed to:

(a) activate the reels upon a wager by a player using the at least one input device;

(b) determine if any of the winning symbol combinations occur in said activation of said reels, and provide the player any of the awards associated with any determined winning symbol combinations which occur in said activation of said reels;

(c) determine if said triggering event occurs in said activation of said reels; and (d) if said triggering event occurs in said activation of said reels, provide a plurality of free activations of said reels, and for said plurality of free activations of said reels:

(i) determine if any of the winning symbol combinations occur in said free activations of said reels, and provide the player any of the awards associated with any of the determined winning symbol combinations which occur in said free activations of said reels, (ii) accumulate any predetermined symbols which occur in said free activations of said reels, and (iii) if a designated number of predetermined symbols are accumulated in at least two of the free activations of said reels, provide at least one additional free activation of said reels, said designated number being at least two.

2. The gaming device of claim 1, wherein the triggering event includes an occurrence of at least one predetermined symbol in said activation of said reels.

3. The gaming device of claim 1, which includes an accumulated symbol display operable to display the predetermined symbols accumulated in the free activations of the reels.

4. The gaming device of claim 1, wherein the designated number is predetermined.

5. The gaming device of claim 1, wherein the designated number is randomly determined.

6. A gaming device operable under control of a processor, said gaming device comprising:

a primary game controlled by the processor;

a set of reels in said primary game, said set of reels including a plurality of reels;

a plurality of symbols on each of the reels;

a triggering event;

a plurality of winning symbol combinations of said symbols;

a plurality of awards associated with the winning symbol combinations;

a secondary game controlled by the processor; and at least one input device in communication with the processor, wherein the processor is programmed to:

(a) activate a play of the primary game upon a wager by a player using the at least one input device;

(b) determine if any of the winning symbol combinations occur in said play of the primary game, and provide the player any of the awards associated with any of the determined winning symbol combinations which occur in said play of the primary game;

(c) determine if said triggering event occurs in said play of said primary game; and (d) if said triggering event occurs in said play of the primary game, provide a play of the secondary game which includes a plurality of activations of said set of reels, and for said play of said secondary game:

(i) determine if any of the winning symbol combinations occur in said activations of said set of reels, and provide the player any of the awards associated with any determined winning symbol combinations which occur in said activations of said set of reels, (ii) accumulate any predetermined symbols which occur in said activations of said set of reels, and (iii) if a designated number of predetermined symbols are accumulated in at least two of the activations of said set of reels, provide a retrigger of the secondary game or a portion of the secondary game, said designated number being at least two.

7. The gaming device of claim 6, wherein the triggering event includes an occurrence of at least one predetermined symbol in the primary game.

8. The gaming device of claim 6, which includes an accumulated symbol display operable to display the predetermined symbols accumulated in the play of the secondary game.

9. The gaming device of claim 6, wherein the designated number is predetermined.

10. The gaming device of claim 6, wherein the designated number is randomly determined.

11. A gaming device operable under control of a processor, said gaming device comprising:

a primary game controlled by the processor;

a plurality of primary game symbols in said primary game;

a triggering event;

a plurality of primary game winning symbol combinations of said primary game symbols;

a plurality of primary game awards associated with the primary game winning symbol combinations;

a secondary game controlled by the processor;

a plurality of secondary game symbols in said secondary game;

a plurality of secondary game winning symbol combinations of said secondary game symbols;

a plurality of secondary game awards associated with the secondary game winning symbol combinations; and at least one input device in communication with the processor, wherein the processor is programmed to:

(a) activate the primary game upon a wager by a player using the at least one input device;

(b) determine if any of the primary game winning symbol combinations occur in said activation of said primary game, and provide the player any of the primary game awards associated with any of the determined primary game winning symbol combinations which occur in said activation of said primary game;

(c) determine if said triggering event occurs in said activation of said primary game; and (d) if said triggering event occurs in said activation of said primary game, provide a plurality of activations of said secondary game, and for said plurality of activations of said secondary game:

(i) determine if any of the secondary game winning symbol combinations occur in said activations of said secondary game, and provide the player any of the secondary game awards associated with any of the determined secondary game winning symbol combinations which occur in said activations of said secondary game, (ii) accumulate any predetermined secondary game symbols which occur in said activations of said secondary game, and (iii) if a designated number of predetermined secondary game symbols are accumulated in at least two of the activations of said secondary game, provide at least one additional activation of said secondary game, said designated number being at least two.

12. The gaming device of claim 11, wherein the triggering event includes an occurrence of at least one predetermined secondary game symbol in said activation of said primary game.

13. The gaming device of claim 11, which includes an accumulated symbol display operable to display the predetermined secondary game symbols accumulated in the plurality of activations of the secondary game.

14. The gaming device of claim 11, wherein the designated number secondary game is predetermined.

15. The gaming device of claim 11, wherein the designated number secondary game is randomly determined.

16. The gaming device of claim 11, wherein the plurality of primary game symbols and the plurality of secondary game symbols are the same.

17. The gaming device of claim 16, wherein the plurality of primary game winning symbol combinations and the plurality of secondary game winning symbol combinations are the same.

18. The gaming device of claim 17, wherein the plurality of primary game awards and the plurality of secondary game awards are the same.

19. The gaming device of claim 11, wherein the plurality of primary game winning symbol combinations and the plurality of secondary game winning symbol combinations are the same.

20. The gaming device of claim 19, wherein the plurality of primary game awards and the plurality of secondary game awards are the same.

21. The gaming device of claim 11, wherein the plurality of primary game awards and the plurality of secondary game awards are the same.

22. A gaming device operable under control of a processor, said gaming device comprising:

a primary game controlled by the processor;

a secondary game including a plurality of free spins, said secondary game controlled by the processor;

a secondary game triggering event in the primary game which triggers the secondary game;

a secondary game re-trigger which provides at least one additional free spin in the secondary game; and an accumulator in the secondary game which is adapted to accumulate secondary game re-triggering symbols in the secondary game, wherein a secondary game re-trigger is provided to a player if the accumulator accumulates a designated number of secondary game re-triggering symbols in at least two free spins of said secondary game, said designated number being at least two.

23. The gaming device of claim 22, which includes an accumulated symbol display operable to display the secondary game re-triggering symbols accumulated in the secondary game.

24. The gaming device of claim 22, wherein the designated number is predetermined.

25. The gaming device of claim 22, wherein the designated number is randomly determined.

26. A gaming device operable under control of a processor, said gaming device comprising:

a plurality of reels controlled by the processor;

a plurality of symbols on each of the reels;

a triggering event;

a plurality of winning symbol combinations of said symbols;

a plurality of awards associated with the winning symbol combinations; and at least one input device in communication with the processor, wherein the processor is programmed to:

(a) activate the reels upon a wager by a player using the at least one input device;

(b) determine if any of the winning symbol combinations occur in said activation of said reels, and provide the player any of the awards associated with any determined winning symbol combinations which occur in said activation of said reels;

(c) determine if said triggering event occurs in said activation of said reels; and (d) if said triggering event occurs in said activation of said reels, provide a plurality of free activations of said reels, and for said plurality of free activations of said reels:

(i) determine if any of the winning symbol combinations occur in said free activations of said reels, and provide the player any of the awards associated with any of the determined winning symbol combinations which occur in said free activations of said reels, (ii) accumulate any predetermined symbols which occur in said free activations of said reels, wherein each predetermined symbol which occurs on said reels is accumulated into a total number of accumulated predetermined symbols without regard to the reel on which said predetermined symbol occurs, and (iii) if said total number of accumulated predetermined symbols reaches a designated number of predetermined symbols in at least two of the free activations of said reels, provide an additional award to the player, wherein the additional award is independent of the awards associated with any of the determined winning symbol combinations.

27. The gaming device of claim 26, wherein the triggering event includes an occurrence of at least one of the predetermined symbols in said activation of said reels.

28. The gaming device of claim 26, which includes an accumulated symbol display operable to display the predetermined symbols accumulated in the free activations of the reels.

29. The gaming device of claim 26, wherein the designated number is predetermined.

30. The gaming device of claim 26, wherein the designated number is randomly determined.

31. The gaming device of claim 26, wherein the additional award includes at least one free activation of said reels.

32. A method of operating a gaming device, said method comprising:

(a) activating a plurality of reels upon a wager by a player, wherein each of the reels includes a plurality of symbols;

(b) determining if any of a plurality of winning symbol combinations occur in said activation of said reels, and provide the player any awards associated with any determined winning symbol combinations which occur in said activation of said reels;

(c) determining if a triggering event occurs in said activation of said reels; and (d) if said triggering event occurs in said activation of said reels, providing a plurality of free activations of said reels, and for said plurality of free activations of said reels:

(i) determining if any of the winning symbol combinations occur in said free activations of said reels, and provide the player any of the awards associated with any of the determined winning symbol combinations which occur in said free activations of said reels, (ii) accumulating any predetermined symbols which occur in said free activations of said reels, wherein each predetermined symbol which occurs on said reels is accumulated into a total number of accumulated predetermined symbols without regard to the reel on which said predetermined symbol occurs, and (iii) if said total number of accumulated predetermined symbols reaches a designated number of predetermined symbols in at least two of the free activations of said reels, providing an additional award to the player, wherein the additional award is independent of the awards associated with any of the determined winning symbol combinations.

33. The method of claim 32, wherein the triggering event includes an occurrence of at least one of the predetermined symbols in said activation of said reels.

34. The method of claim 32, which includes displaying the predetermined symbols accumulated in the free activations of the reels.

35. The method of claim 32, wherein the designated number is predetermined.

36. The method of claim 32, wherein the designated number is randomly determined.

37. The method of claim 32, wherein the additional award includes at least one free activation of said reels.

38. The method of claim 32, which is provided through a data network.

39. The method of claim 38, wherein the data network is an internet.

* * * * *